US007397452B2

(12) United States Patent
Nakamura

(10) Patent No.: US 7,397,452 B2
(45) Date of Patent: Jul. 8, 2008

(54) DISPLAY APPARATUS AND ITS CONTROL METHOD

(75) Inventor: Norio Nakamura, Kanazawa (JP)

(73) Assignee: Toshiba Matsushita Display Technology Co., Ltd., Tokyo (JP)

( * ) Notice: Subject to any disclaimer, the term of this patent is extended or adjusted under 35 U.S.C. 154(b) by 553 days.

(21) Appl. No.: 11/171,301

(22) Filed: Jul. 1, 2005

(65) Prior Publication Data

US 2005/0237002 A1 Oct. 27, 2005

Related U.S. Application Data

(63) Continuation of application No. PCT/JP03/16570, filed on Dec. 24, 2003.

(30) Foreign Application Priority Data

Jan. 8, 2003 (JP) ..... 2003-002371

(51) Int. Cl.
*G09G 5/00* (2006.01)

(52) U.S. Cl. ..... 345/76; 345/77; 315/169.3

(58) Field of Classification Search ..... 345/45–53, 345/55, 74.1, 76, 77, 81, 83–84, 87, 90, 92, 345/211–214; 315/169.1, 169.2, 169.3, 169.4
See application file for complete search history.

(56) References Cited

U.S. PATENT DOCUMENTS 6,246,180 B1 6/2001 Nishigaki
6,710,548 B2 * 3/2004 Kimura ..... 315/169.3
6,980,180 B2 * 12/2005 Hasagawa ..... 345/77
7,274,363 B2 * 9/2007 Ishizuka et al. ..... 345/211
2002/0030647 A1 * 3/2002 Hack et al. ..... 345/82
2005/0068270 A1 * 3/2005 Awakura et al. ..... 345/76

FOREIGN PATENT DOCUMENTS

CN 1377495 10/2002
EP 1 225 557 A1 7/2002
EP 1 231 592 A2 8/2002

(Continued)

OTHER PUBLICATIONS

D. Fish, et al. "32.1: Invited Paper: A Comparison of Pixel Circuits for Active Matrix Polymer/Organic LED Displays", SID 02 Digest, XP-007007997, vol. XXXIII, 2002, pp. 968-971.

*Primary Examiner*—Richard A. Hjerpe
*Assistant Examiner*—Mansour M. Said
(74) *Attorney, Agent, or Firm*—Oblon, Spivak, McClelland, Maier & Neustadt, P.C.

(57) ABSTRACT

A display apparatus is provided which can perform display of high visibility with the load on a power supply for supplying power to display elements. A display screen is provided with a plurality of pixels arranged in an array. Each pixel includes a display element and a driving circuit for supplying the display element with a current corresponding to a video signal. A display state detection circuit detects the display state of the display screen twice or more within a one-frame period. A dimming circuit varies a current supply time to supply a current from the driving circuit to the display element, in accordance with an output from the display state detection circuit, and performs dimming control twice or more within a one-frame period.

13 Claims, 6 Drawing Sheets

FOREIGN PATENT DOCUMENTS

| | | |
|---|---|---|
| JP | 7-181911 | 7/1995 |
| JP | 10-319910 | 12/1998 |
| JP | 2000--187467 | 7/2000 |
| JP | 2000-221945 | 8/2000 |
| JP | 2000-322022 | 11/2000 |
| JP | 2001-60076 | 3/2001 |
| JP | 2001-350442 | 12/2001 |
| JP | 2003-122305 | 4/2003 |
| TW | 486683 | 5/2002 |

* cited by examiner

DISPLAY APPARATUS AND ITS CONTROL METHOD

CROSS-REFERENCE TO RELATED APPLICATIONS

This is a Continuation Application of PCT Application No. PCT/JP03/16570, filed Dec. 24, 2003, which was published under PCT Article 21(2) in Japanese.

This application is based upon and claims the benefit of priority from prior Japanese Patent Application No. 2003-002371, filed Jan. 8, 2003, the entire contents of which are incorporated herein by reference.

BACKGROUND OF THE INVENTION

1. Field of the Invention

The present invention relates to a display apparatus, and more particularly to a display apparatus in which the optical characteristic of a display element is controlled by a current passing therethrough, and a control method for the apparatus.

2. Description of the Related Art

In organic electroluminescence (EL) display apparatuses, the brightness of an organic EL element is controlled by a current passing therethrough. Accordingly, the larger the driving current, the higher the brightness of the organic EL element. Further, the sum of the driving currents passing through all pixels is maximum when maximum gradation display is performed over the entire screen.

If the maximum value of the sum of the driving currents of all pixels is high, the power consumption is high, and an expensive large power supply circuit is required. Further, in this case, the temperature of the display apparatus is increased and the life is reduced. Accordingly, there is a need for reducing the maximum value of the sum of the driving currents passing through all pixels.

BRIEF SUMMARY OF THE INVENTION

The present invention has been developed in light of the above problem, and aims to provide a display apparatus capable of realizing display of high visibility at a low load on the power supply for supplying power to a display element, and a control method employed in the apparatus.

According to an aspect of the present invention, a display apparatus comprising, a display screen including a plurality of pixels, each of the pixels including a display element and a driving circuit, the display element being provided between a pair of opposing electrodes and including an optical layer having an optical characteristic thereof varied in accordance with an amount of current, the driving circuit supplying the display element with a current corresponding to a video signal, a display state detection circuit configured to detect a display state of the display screen twice or more within a non-frame period, and a dimming circuit configured to vary a current supply time to supply a current from the driving circuit to the display element, in accordance with an output from the display state detection circuit, the dimming circuit performing dimming control twice or more within a one-frame period.

DETAILED DESCRIPTION OF THE INVENTION

Figure 1:
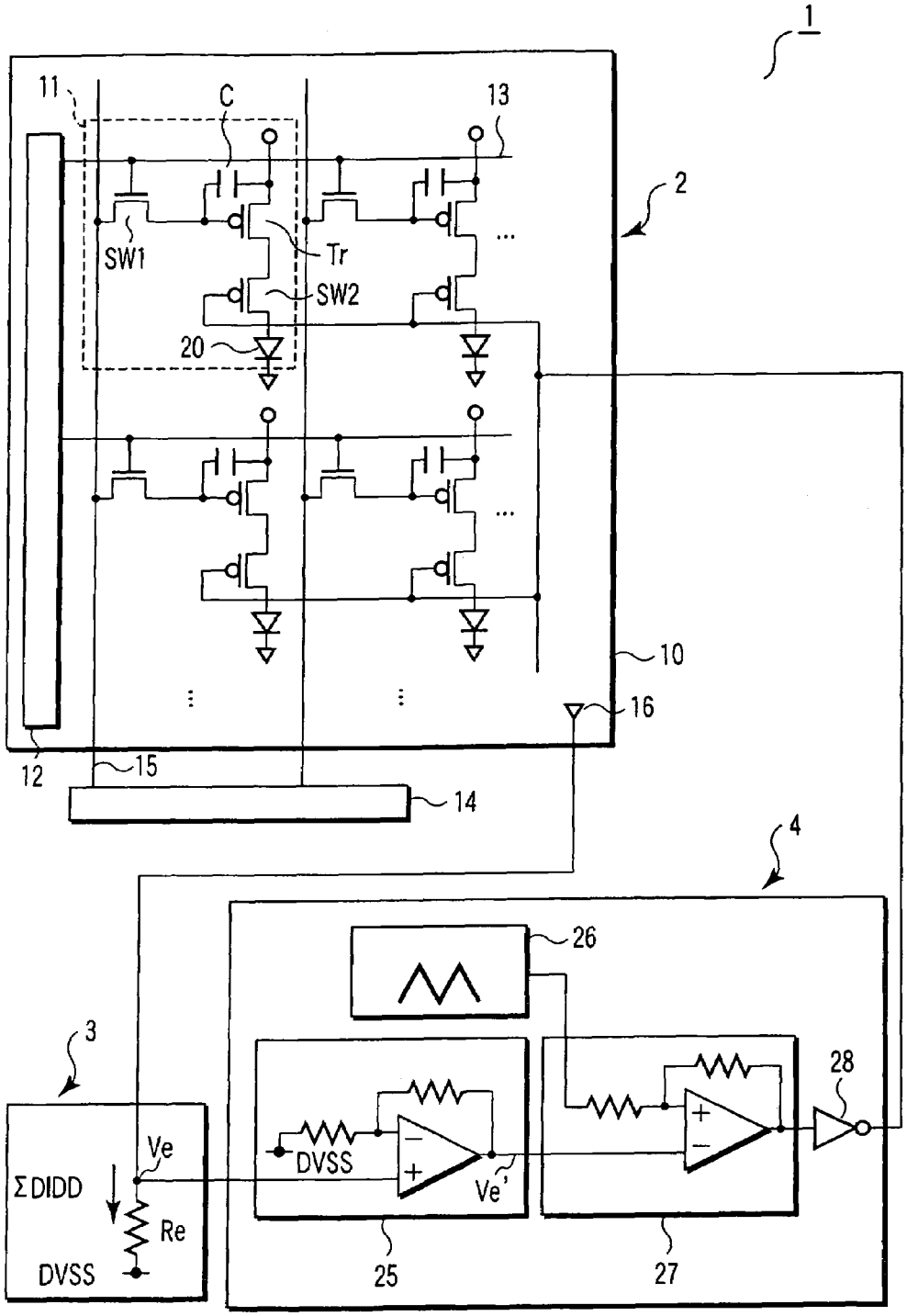
FIG. 1 is a view illustrating a display apparatus according to a first embodiment of the invention.

Referring the accompanying drawings, embodiments of the invention will be described. In the drawings, like reference numerals denote like elements, and no duplicate description will be given.

FIG. 1 is a schematic view illustrating a display apparatus according to a first embodiment of the invention. The display apparatus 1 shown in FIG. 1 is, for example, an organic EL display apparatus, and comprises an organic EL panel 2, display state detection circuit 3 and dimming circuit 4.

The organic EL panel 2 includes an insulation substrate 10 formed of, for example, glass, and pixels 11 arranged in a matrix on the substrate 10. On the substrate 10, there are further provided scanning signal lines 13 connected to a scanning signal line driver 12, and video signal lines 15 connected to a video signal driver 14, the lines 13 and 15 being intersecting each other. For instance, the scanning signal line driver 12 is formed on the insulation substrate 10 integral therewith as one body, in the same process as, for example, TFT elements serving as pixels described later. Further, the video signal driver is formed of a TCP (Tape carrier package), and is used to connect the organic EL panel to a PCB (Printed circuit board), on which a display state detection circuit, for example, is formed. The video signal driver may be formed integral with the insulation substrate in the same manner as the scanning signal line driver, or may be mounted as a COF (chip on film) or COG (chip on glass). However, it is desirable that this driver be mounted as a COG to drive pixels using a current.

Each pixel 11 comprises a driving transistor Tr for outputting a driving current corresponding to an input video signal, capacitor C, selection switch SW1, output control switch SW2 and organic EL element 20. Of these elements, the driving transistor Tr, capacitor C and selection switch SW1 form a driving circuit. Assume here that the driving transistor Tr and output control switch SW2 are p-channel transistors, and the selection switch SW1 is an n-channel transistor.

The organic EL element 20 has a structure in which an organic layer containing a light-emitting layer is interposed between the anode and cathode. In each pixel 11, the anode of the organic EL element 20 is connected to the driving circuit via the output control switch SW2. Further, the cathode of the organic EL element 20 is provided as a common electrode connected to each pixel. The anode is connected to a first power supply terminal set to a first power supply voltage DVDD, while the cathode is connected to a second power supply terminal set to a second power supply voltage DVSS lower than the first power supply voltage DVDD.

The display state detection circuit 3 is connected to the cathode of the organic EL element 20 via, for example, a cathode terminal 16 incorporated in the organic EL panel 2 for external connection. As previously described, the cathode of the organic EL element 20 is provided as a common electrode, therefore the current flowing into the display state detection circuit 3 is equal to the sum ΣDIDD of the driving currents DIDD flowing into the organic EL elements 20 of all the pixels 11. The display state detection circuit 3 outputs a signal acquired by subjecting the current ΣDIDD into current-to-voltage conversion, for example, a voltage Ve proportional to the current ΣDIDD. The display state detection circuit 3 may be called a current detection circuit or current-to-voltage conversion circuit.

The dimming circuit 4 comprises, for instance, a signal amplification unit 25, frequency signal generation unit 26, comparator 27 and inverter 28.

The signal amplification unit 25 amplifies the output signal Ve from the display state detection circuit 3 into Ve'.

Figure 8A:
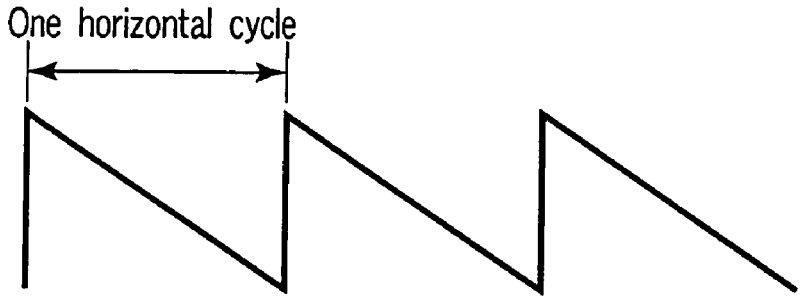
FIGS. 8A, 8B and 8C are views illustrating examples of frequency signals acquired from a dimming circuit.
Figure 8B:
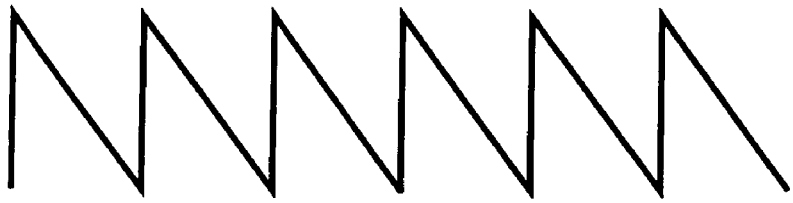
Figure 8C:
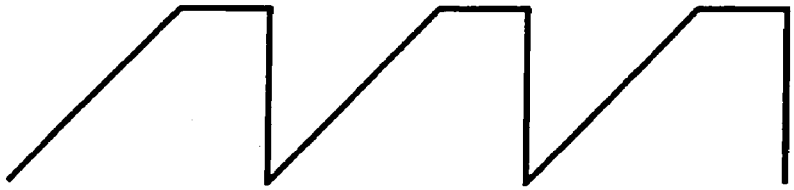

The frequency signal generation unit 26 does not generate a frequency signal, such as a rectangular wave signal, having its level varied between two values, but generates a frequency signal having its level varied between three or more values, preferably, a frequency signal, such as a chopping wave signal or sine wave signal, that has its level varied continuously and repeats the same waveform periodically. Although in the embodiment, the cycle of the frequency signal is made correspond to one horizontal cycle to enable brightness control in units of horizontal cycles, the invention is not limited to this. It is sufficient if the cycle of the frequency signal is determined in accordance with the cycle of dimming. Note here that the cycle of dimming corresponds to an integral multiple of the cycle of the frequency signal. FIG. 8 shows examples of frequency signals. The frequency signal may be the one as shown in FIG. 8A that varies from a first potential to a second potential in units of horizontal cycles, or the one as shown in FIG. 8B that exhibits a repetition pattern in each horizontal cycle, or may have a trapezoidal shape as shown in FIG. 8C. If the frequency signal is made to have the shape shown in FIG. 8A or 8B that continuously varies from a certain high potential to a certain low potential when the cycle of dimming progresses from the start to the end, start of the emission period can be adjusted to the dimming cycle, which facilitates signal control.

The comparator 27 compares the amplified Ve' with the frequency signal, and generates a signal of a substantially rectangular waveform (hereinafter referred to as a "rectangular wave signal). The inverter 28 subjects the rectangular wave signal to conversion such as inversion. The dimming circuit 4 sends the whole rectangular wave signal to the control terminal (in this embodiment, the gate) of the output control switch SW2, thereby controlling the open/closure of the output control switch SW2.

The above-described display apparatus 1 performs, for example, the following display:

During writing, a scanning signal sent from a scanning signal line 13 to the selection switch SW1 of a certain pixel 11 makes an on-state of the selection switch SW1, whereby a video signal is sent from a corresponding video signal line 15 to the gate of the driving transistor Tr of the pixel. The period of writing finishes when the selection switch SW1 is turned off.

In an emission period after the writing period, the capacitor C holds substantially constant the voltage between the gate and source of the driving transistor Tr. As a result, as long as the output control switch SW2 is turned on, a current corresponding to a video signal continues to flow into the corresponding organic EL element 20. The period of emission continues until the next writing period starts.

While performing display as described above, the display apparatus 1 can perform dimming, for example, as stated below.

Figure 2:
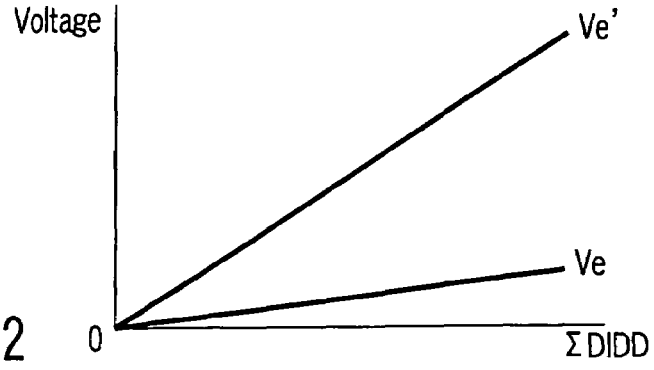
FIG. 2 is a graph illustrating a relationship example between a current ΣDIDD and signals Ve and Ve'.
Figure 3A:
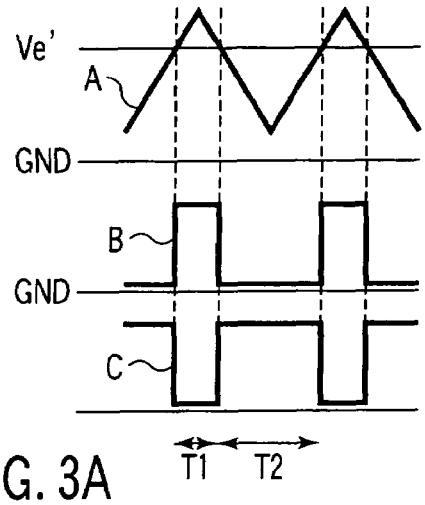
FIGS. 3A and 3B are graphs illustrating relation-ship examples between the signal Ve' and a rectangular wave signal output from a dimming circuit 4.
Figure 3B:
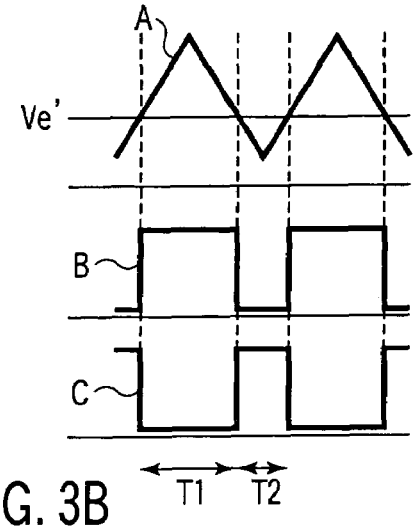

FIG. 2 is a graph illustrating a relationship example between the current ΣDIDD and signals Ve and Ve'. In the figure, the abscissa indicates the current ΣDIDD, and the ordinate indicates the voltage. Further, FIGS. 3A and 3B are graphs illustrating relationship examples between the signal Ve' and a rectangular wave signal output from the dimming circuit 4. In the figure, the abscissa indicates the time, and the ordinate indicates the voltage. The graphs of FIGS. 3A and 3B are drawn on the assumption that the frequency signal generation unit 26 generates a frequency signal A of chopping waves.

In the display apparatus 1 shown in FIG. 1, the signals Ve and Ve' are proportional to the current ΣDIDD as shown in FIG. 2. Accordingly, if the area ratio of a high-gradation display portion to the entire screen is high, the current ΣDIDD is large and hence the level of the signal Ve' is high.

When the level of the signal Ve' is high, the signal Ve' and frequency signal A have the relationship shown, for example, in FIG. 3A. Under this relationship, a rectangular wave signal B generated by the comparator 27 after a comparison between the signal Ve' and frequency signal A, and a rectangular wave signal C generated by the inverter 28 after the conversion of the rectangular wave signal B have the respective waveforms shown in FIG. 3A. That is, the time T1 during which the output control switch SW2 is turned on is short, and the time T2 during which the output control switch SW2 is turned off is long.

On the other hand, if the area ratio of a low-gradation display portion to the entire screen is high, the current ΣDIDD is small and hence the level of the signal Ve' is low. When the level of the signal Ve' is low, the signal Ve' and frequency signal A have the relationship shown, for example, in FIG. 3B. Under this relationship, the rectangular wave signals B and C have the respective waveforms shown in FIG. 3B. That is, the time T1 during which the output control switch SW2 is turned on is long, and the time T2 during which the output control switch SW2 is turned off is short.

The above-described dimming can reduce the load on the power supply for supplying power to each organic EL element 20, and enables display of high visibility as stated below.

Figure 4:
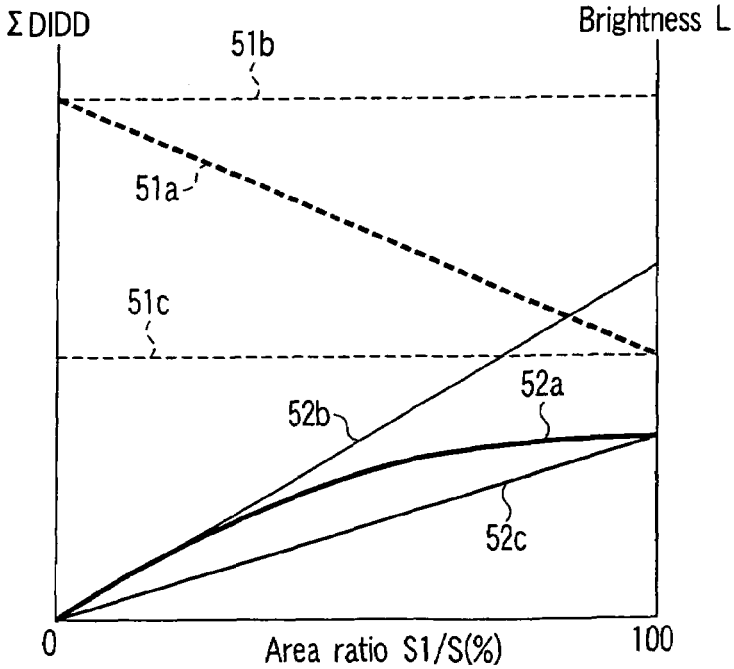
FIG. 4 is a graph illustrating examples of brightness and power consumption realized when dimming is performed as shown in FIGS. 3A and 3B.

FIG. 4 is a graph illustrating examples of brightness and power consumption realized when dimming is performed as shown in FIGS. 3A and 3B. In the figure, the abscissa indicates the ratio S1/S of the area S1 of a maximum gradation display portion to the entire area S of the screen, and the ordinate indicates the current ΣDIDD and the brightness L of each pixel 11 included in the maximum gradation display portion.

In FIG. 4, the broken lines 51*a* to 51*c* indicate data concerning the brightness L, and the solid lines 52*a* to 52*c* indicate data concerning the current ΣDIDD. Specifically, the data indicated by the broken line 51*a* and solid line 52*a* was acquired when dimming as shown in FIGS. 3A and 3B was performed. Further, the data indicated by the broken line 51*b* and solid line 52*b* was acquired when the ratio T2/T1 of the time T1 in which the output control switch SW2 is turned on, to the time T2 in which the output control switch SW2 is turned off was set to zero regardless of the area ratio S1/S, i.e., when the output control switch SW2 was always turned on. Furthermore, the data indicated by the broken line 51*c* and solid line 52*c* was acquired when the ratio T2/T1 was set to 0.5 regardless of the area ratio S1/S.

If the output-control switch SW2 is always closed, the brightness L of each pixel 11 included in the maximum gradation display portion is sufficiently high regardless of the area ratio S1/S, as indicated by the broken line 51*b* and solid line 52*b* in FIG. 4. Accordingly, even if the area ratio S1/S is low, display of high visibility can be realized. This way, however, if the area ratio S1/S is increased, the current ΣDIDD is significantly increased, resulting in a significant increase in the load on the power supply for supplying power to each organic EL element 20.

Further, if the ratio T2/T1 is set to 0.5 regardless of the area ratio S1/S, the current ΣDIDD is prevented from being significantly increased even if the area ratio S1/S is increased, as indicated by the broken line Sic and solid line 52*c*. This reduces the load on the power supply for supplying power to each organic EL element 20. This way, however, reduces, substantially by half, the brightness L of each pixel 11 included in the maximum gradation display portion, compared to the way of always closing the output control switch SW2. In other words, if the area ratio S1/S is low, display of high visibility cannot be is achieved.

On the other hand, if dimming is performed in the manner described with reference to FIGS. 3A and 3B, the brightness L of each pixel 11 included in the maximum gradation display portion is reduced in proportion to increases in the area ratio S1/S, as indicated by the broken line 51*a* and solid line 52*a*. Thus, the current ΣDIDD is prevented from being significantly increased when the area ratio S1/S is increased, thereby reducing the load for applying the power of the source to the organic EL element 20, compared to the way of always turning on the output control switch SW2. Furthermore, since the brightness L of each pixel 11 included in the maximum gradation display portion is increased in accordance with a reduction in the area ratio S1/S, display of high visibility can be realized even if the area ratio S1/S is low.

As described above, the embodiment realizes both a reduction in the load on the power supply for supplying power to each organic EL element 20, and display of high visibility.

Thus, dimming can be commonly performed on all pixels in accordance with the sum ΣDIDD of the currents flowing into all pixels. Moreover, since a feedback operation is performed on each pixel, display of high definition and low consumption power driving can be realized. In addition, the heat generated by each organic EL element can be effectively reduced.

Specifically, instead of detecting the display state of one frame and using the detection result for dimming of the next frame, dimming is performed a number of times in the middle of processing of one frame, i.e., during writing of one frame. As a result, dimming is performed gradually. Therefore, even if the state of display is completely changed, i.e., even if, for example, entirely black display is changed to entirely white display, more accurate setting for dimming can be realized in accordance with the display state. Also, degradation of visibility due to an abrupt change in brightness can be suppressed.

Furthermore, since control is performed by comparing a continuously-level-varying frequency signal with the detection result of the display state detection circuit, the brightness used in dimming can be adjusted not only to predetermined stepwise levels but also to any level.

The requirements that form the basic concept of the present invention constructed as above will be summarized below. (a) A display screen 2 incorporates a plurality of pixels 11 that each comprises a display element 20 and driving circuits (Tr, C, SW1), the display element provided between a pair of opposing electrodes and including an optical layer having its optical characteristic varied in accordance with the amount of current flowing therethrough, the driving circuits supplying the display element with a current corresponding to a video signal. (b) The display state detection circuit 3 detects the display state of the display screen 2 twice or more during a one-frame period. (c) The dimming circuit 4 can periodically and simultaneously switch the supply/non-supply of power from the power supply to the display elements of a plurality of pixels. This circuit also can vary, in each cycle, the ratio of the power supply time to the power non-supply time in accordance with the output of the display state detection circuit 3, thereby supplying control pulses to the output control switch so that dimming control will be performed twice or more within a one-frame period.

Specifically, the closed and open states of the output control switches of all pixels are simultaneously controlled using the step of detecting the sum of the currents flowing into a plurality of organic EL elements 20, the step of at least comparing a frequency signal of a short cycle shorter than one vertical cycle with the detection result concerning the sum of the currents, and a control pulse signal (i.e., a rectangular wave signal) based on the comparison result. In other words, the step of varying the duty ratio of the control pulse signal in accordance with the sum of the currents is employed.

Further, in the invention, the dimming circuit 4 may be modified in various ways. In the above-described embodiment, the voltage detection circuit 3 converts, into a voltage, the detected sum of the currents flowing through a plurality of display elements, and outputs the detected voltage. The dimming circuit 4 includes the amplifier 25 for amplifying the detected voltage, and the comparator 27 for comparing the output level of the amplifier 25 with a level comparison signal of a reference potential, and varying the duty ratio of the control pulse signal in accordance with the level difference. However, various methods may be used to change the pulse duty ratio in accordance with the detected voltage. For example, a value obtained by converting the detected voltage may be used as a preset value for a programmable counter, and signals output from the programmable counter when the counter is set and reset may be used as pulse-width conversion outputs (control pulses).

The control pulse signal has a cycle shorter than one vertical cycle. Accordingly, it enables realtime control. Specifically, if, for example, the cycle of the control pulse signal is set to a value corresponding to one horizontal cycle, two horizontal cycles or three horizontal cycles, when data corresponding one line, two lines or three lines is rewritten, whole dimming is performed. Of course, the cycle of the control pulse signal may be set to a value shorter than one horizontal cycle, e.g., ½ or ⅓ the horizontal cycle. Alternatively, the cycle may be set to ½, ⅓ or ¼ the vertical cycle. Furthermore, a function for switching the cycle of the control pulse signal in accordance with a picture displayed may be additionally employed.

A second embodiment of the invention will be described.

Figure 5:
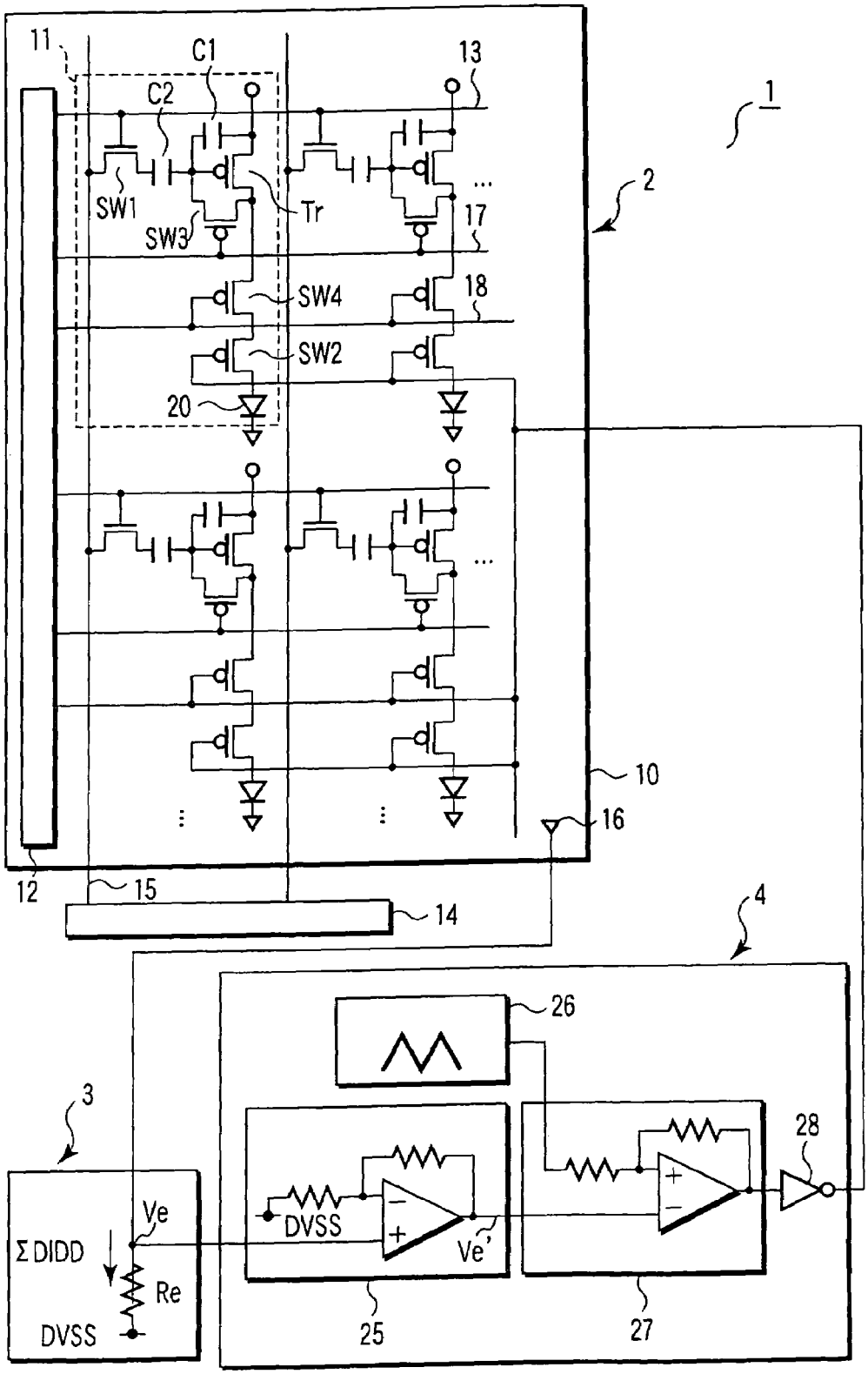
FIG. 5 is a view illustrating a display apparatus according to a second embodiment of the invention.

FIG. 5 is a schematic view illustrating a display apparatus according to the second embodiment of the invention. The display apparatus 1 shown in FIG. 5 is, for example, an organic EL display apparatus, and comprises an organic EL panel 2, display state detection circuit 3 and dimming circuit 4. The organic EL display apparatus 1 has substantially the same structure as the organic EL display apparatus shown in FIG. 1, except for the structure of each pixel 11 of the organic EL panel 2, in particular, the structure of the driving circuit.

The organic EL panel 2 includes a substrate 10, and pixels 11 arranged in a matrix on the substrate 10. On the substrate 10, there are further provided scanning signal lines 13 and control lines 17 and 18 connected to a scanning signal line driver 12, and video signal lines 15 connected to a video signal line driver 14 and intersecting the former lines.

Each pixel 11 comprises a driving transistor Tr, capacitors C1 and C2, selection switch SW1, output control switch SW2, correction switches SW3 and SW4 and organic EL element 20. Of these elements, the driving transistor Tr, capacitors C1 and C2, selection switch SW1 and correction switches SW3 and SW4 form a driving circuit. In this embodiment, assume, for example, that the driving transistor Tr, output control switch SW2 and correction switches SW3 and SW4 are p-channel transistors, and the selection switch SW1 is an n-channel transistor.

The above-described display apparatus 1 performs display as explained below.

During writing, after the correction switch SW4 is opened, firstly, the correction switch SW3 is closed, thereby charging the capacitors C1 and C2 until a current stops flowing between the source and drain of the driving transistor Tr. In this state, the drain and gate of the driving transistor Tr are connected, therefore the voltage between the gate and source of the driving transistor Tr is equal to its threshold voltage. During this period, the scanning signal line driver 12 sends a scanning signal to each scanning signal line 13 to close the selection switch SW1, and the video signal line driver 14 sends a reset signal to each video signal line 15.

After finishing the above operations, the correction switch SW3 is opened, and the video signal line driver 14 sends a video signal to each video signal line 15. As a result, the voltage between the gate and source of the driving transistor Tr varies from the threshold value by the difference between the video signal and reset signal. After that, the selection switch SW1 is opened, which is the termination of the writing period.

During emission, the capacitor C1 holds substantially constant the voltage between the gate and source of the driving transistor Tr. As a result, as long as the output control switch SW2 is closed, a current corresponding to the difference between the video signal and reset signal continues to flow into the corresponding organic EL element 20. The period of emission continues until the next writing period starts.

The above-described way of display can eliminate the influence of the threshold voltage Vth of the driving transistor Tr upon the driving current DIDD. Therefore, if the threshold voltage Vth of the driving transistor Tr varies between pixels 11, the influence of the variation upon the driving current DIDD can be minimized.

Further, this embodiment can perform dimming similar to that described in the first embodiment. Accordingly, this embodiment can reduce the load on the power supply for supplying power to each organic EL element 20, and realize display of high visibility.

A third embodiment of the invention will be described.

Figure 6:
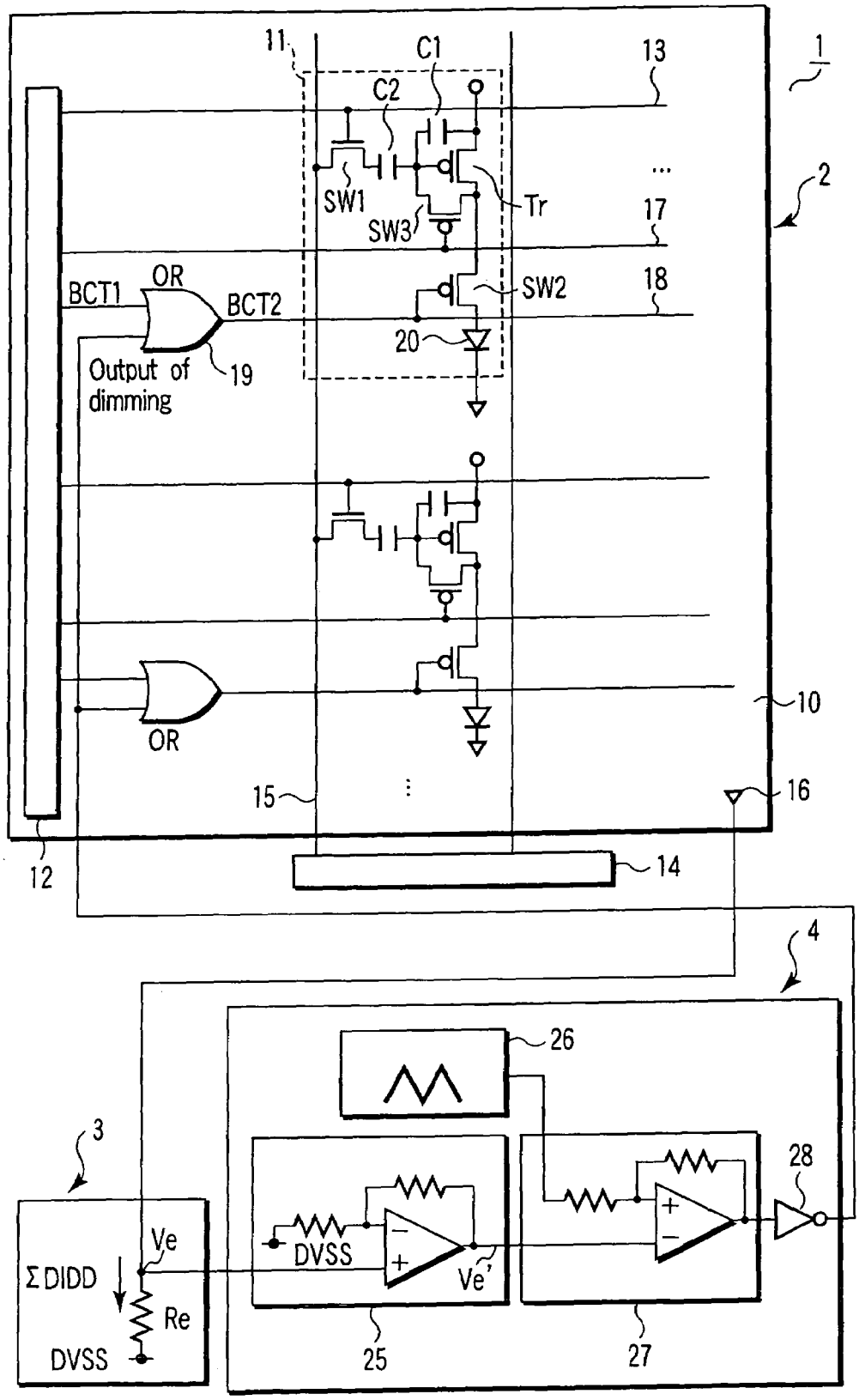
FIG. 6 is a view illustrating a display apparatus according to a third embodiment of the invention.

FIG. 6 is a schematic view illustrating a display apparatus according to the third embodiment of the invention. The display apparatus 1 shown in FIG. 6 is, for example, an organic EL display apparatus, and comprises an organic EL panel 2, display state detection circuit 3 and dimming circuit 4. The display apparatus 1 has substantially the same structure as the organic EL display apparatus 1 shown in FIG. 5, except for the structure of each pixel 11 of the organic EL panel 2. That is, in each pixel 11 employed in this embodiment, the output control switch SW2 also has a function corresponding to the function of the above-mentioned correction switch SW4. The output control switch SW2 is controlled by an OR logic circuit 19 provided in a non-display area for each row of pixels.

The organic EL panel 2 includes a substrate 10, and pixels 11 arranged in a matrix on the substrate 10. On the substrate 10, there are further provided scanning signal lines 13 and control lines 17 connected to a scanning signal line driver 12, and video signal lines 15 connected to a video signal line driver 14 and intersecting the former lines.

Each pixel 11 comprises a driving transistor Tr, capacitors C1 and C2, selection switch SW1, output control switch SW2, correction switch SW3 and organic EL element 20. Of these elements, the driving transistor Tr, capacitors C1 and C2, selection switch SW1 and correction switch SW3 form a driving circuit. In this embodiment, assume, for example, that the driving transistor Tr, output control switch SW2 and correction switch SW3 are p-channel transistors, and the selection switch SW1 is an n-channel transistor.

Further, one OR logic circuit 19 is provided for each row of pixels, and has its respective two input terminals connected to the control signal BCT1 output terminal (control wire 18) of the scanning signal line driver 12, and the output terminal of the dimming circuit 4. Further, the output terminal of each OR logic circuit 19 is connected to the control terminal (gate) of the output control switches SW2 of the corresponding pixel row. Thus, each OR logic circuit 19 uses, as a control signal BCT2, the local sum of the control signal BCT1 and the output (rectangular wave signal) of the dimming circuit 4, thereby controlling the opened/closed states of the corresponding output control switches SW2.

The above-described display apparatus 1 performs, for example, the following display:

During writing, firstly, the scanning signal line driver 12 outputs a control signal BCT1 of high level to open the output control switch SW2 without the output of the dimming circuit. With this state maintained, the correction switch SW3 is closed, thereby charging the capacitors C1 and C2 until a current stops flowing between the source and drain of the driving transistor Tr. In this state, the drain and gate of the driving transistor Tr are connected, therefore the voltage between the gate and source of the driving transistor Tr is equal to its threshold voltage. During this period, the scanning signal line driver 12 sends a scanning signal to each scanning signal line 13 to close the selection switch SW1, and the video signal line driver 14 sends a reset signal to each video signal line 15.

After finishing the above operations, the correction switch SW3 is opened, and the video signal line driver 14 sends a video signal to each video signal line 15. As a result, the voltage between the gate and source of the driving transistor Tr varies from the threshold value by the difference between the video signal and reset signal. After that, the selection switch SW1 is opened, which is the termination of the writing period.

During emission, the capacitor C1 holds substantially constant the voltage between the gate and source of the driving transistor Tr. In the emission period, a control signal BCT1 of low level is also output, whereby the output control switch SW2 is controlled by a rectangular-wave control signal as the output of the dimming circuit 4. As a result, as long as the output control switch SW2 is closed, a current corresponding to the difference between the video signal and reset signal continues to flow into the corresponding organic EL element 20. The period of emission continues until the next writing period starts.

Thus, this embodiment provides the advantage that the required area of the element in each pixel can be reduced, as well as the advantages acquired by the second embodiment.

A fourth embodiment of the invention will now be described.

Figure 7:
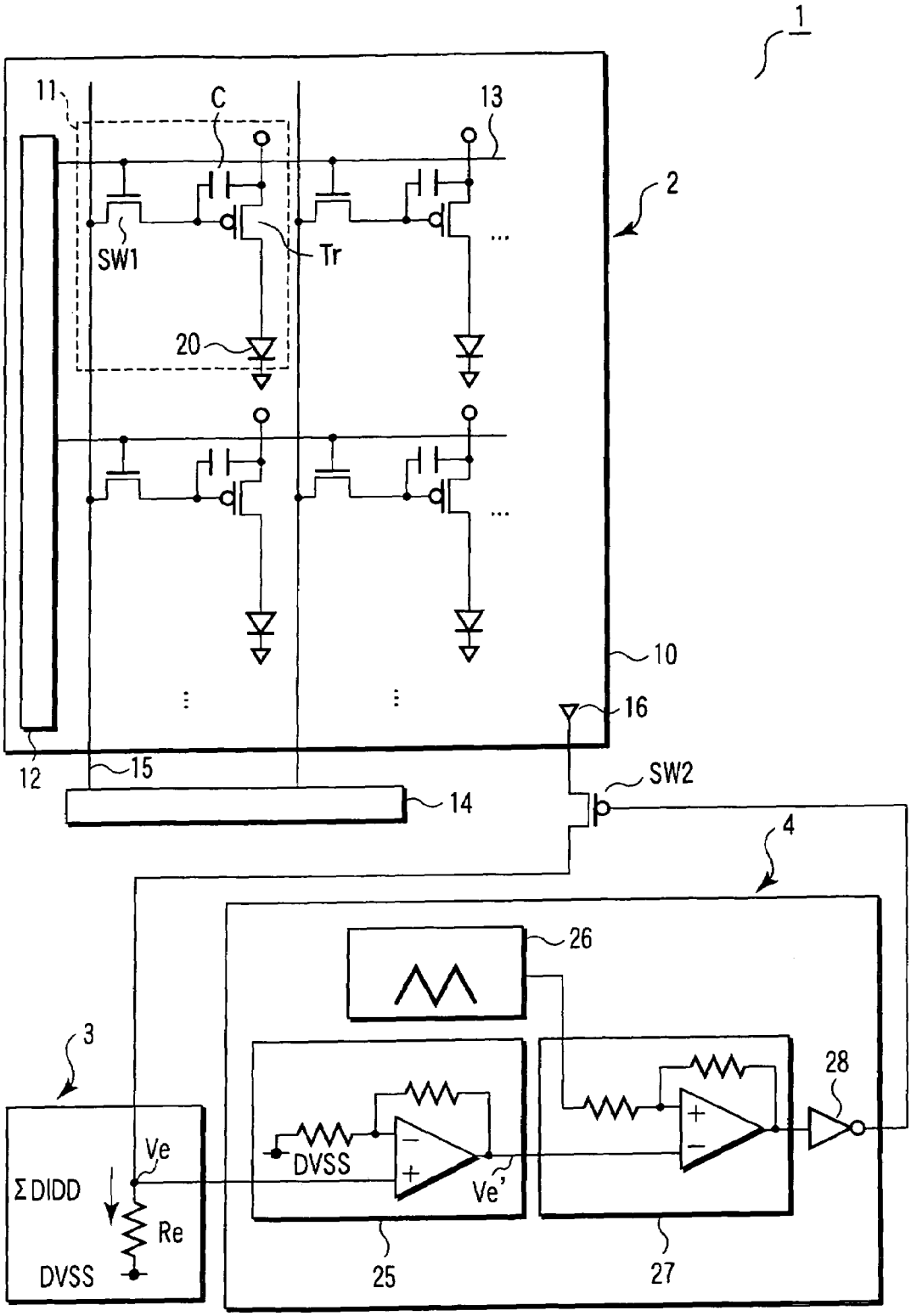
FIG. 7 is a view illustrating a display apparatus according to a fourth embodiment of the invention.

FIG. 7 is a schematic view illustrating a display apparatus according to the fourth embodiment of the invention. The display apparatus 1 shown in FIG. 7 is, for example, an organic EL display apparatus, and comprises an organic EL panel 2, display state detection circuit 3 and dimming circuit 4. The organic EL display apparatus 1 has substantially the same structure as the organic EL display apparatus 1 shown in FIG. 1, except that the connection state of the output control switch SW2 differs. That is, in this embodiment, one output control switch SW2 is commonly provided for a plurality of pixels. FIG. 7 shows a case where a single output control switch SW2 is commonly provided for all pixels. Since the basic concept of the present invention lies in that the whole emission period of the organic EL elements 20 is controlled in accordance with the state of display, a single switch SW2 may be provided across the power supply line between the power supply to the display elements.

In this embodiment, an output control switch is provided between the cathode-side power supply terminal DVSS and the display elements, and the output control switch is, for example, a p-channel transistor.

The above-mentioned provision of a common output control switch for a plurality of pixels is advantageous in designing an element array substrate, since the element density is reduced.

It is possible to form the output control switch SW2 in the array substrate. However, if the switch is formed in the substrate, the area of the peripheral portion (frame) of the substrate is inevitably increased, and the ON resistance and hence the power consumption of the switch is increased. To avoid these disadvantages, it is practical to provide the output control switch SW2 outside the substrate.

In the first to fourth embodiments, the driving circuits, for example, for the pixels 11 are not limited to the structures shown in FIGS. 1, 5, 6 and 7, but can be modified in various ways. For example, instead of the voltage signal driving scheme, a current-mirror type or current-copy type current signal driving scheme may be employed.

Each of the above-described embodiments comprises a plurality of display elements as structural elements incorporated in a plurality of pixels two-dimensionally arranged, each switch being connected in series to the current path of the corresponding display element. They further comprise a current detection circuit and dimming circuit. The current detection circuit detects the sum of the currents flowing into the display elements. The dimming circuit simultaneously opens and closes the switches using a control pulse signal of a cycle at least shorter than one vertical cycle, and varies the duty ratio of the control pulse signal in accordance with the sum of the currents.

In the above-described first to fourth embodiments, the dimming circuit 4 is constructed so that the signal Ve' is proportional to the current ΣDIDD. However, the dimming circuit 4 may subject the signal Ve' to logarithmic transformation so that the signal is proportional to the current ΣDIDD. The resistors incorporated in the signal amplification unit 25 may be replaced with thermistors to perform temperature compensation.

When dimming is performed as shown in FIGS. 3A and 3B, various settings are made so that the maximum level of the signal Ve' is lower than the maximum level of the frequency signal A, and higher than the minimum level of the frequency signal A. The minimum level of the signal Ve' may be higher, equal to, or lower than the minimum level of the frequency signal A.

The first to fourth embodiments are directed to organic EL display apparatuses 1 as examples. However, the previously described advantages can be acquired by other display apparatuses. It is sufficient if each display element comprises a pair of electrodes, and an optical layer having its optical characteristic varied in accordance with the current flowing between the electrodes. For instance, the above advantages can also be acquired by a light-emitting diode display apparatus, field emission display apparatus, etc.

As described above, the present invention provides a display apparatus capable of realizing display of high visibility, with the load on the power supply for supplying power to the display elements reduced.

The present invention is effectively applicable to an organic EL (electroluminescence) display apparatus, emission diode display apparatus, field emission display apparatus, etc.

What is claimed is:

1. A display apparatus comprising:

a display screen including a plurality of pixels, each of the pixels including a display element and a driving circuit, the display element being provided between a pair of opposing electrodes and including an optical layer having an optical characteristic thereof varied in accordance with an amount of current, the driving circuit supplying the display element with a current corresponding to a video signal;

a display state detection circuit configured to detect a display state of the display screen twice or more within a one-frame period; and a dimming circuit configured to vary a current supply time to supply a current from the driving circuit to the display element, in accordance with an output from the display state detection circuit, the dimming circuit performing dimming control twice or more within a one-frame period.

2. The display apparatus according to claim 1, the display element being an organic EL element including an organic layer containing a light-emitting layer.

3. The display apparatus according to claim 1, the display state detection circuit being configured to convert, into a detection voltage, a sum of currents flowing into the display elements of the plurality of pixels, and to output the detection voltage.

4. The display apparatus according to claim 1, the dimming circuit being configured to compare an output result from the display state detection circuit with a frequency signal having a continuously varying level and repeating a predetermined cycle, and to output a control pulse signal for controlling the current supply period.

5. The display apparatus according to claim 4, the cycle of the frequency signal being set to ½ or less a vertical cycle.

6. The display apparatus according to claim 4, further comprising a pair of power supply terminals for supplying the respective electrodes with a predetermined potential, and a switch connected between the display element and one of the pair of power supply terminals, and the control pulse signal output from the dimming circuit being supplied to a control electrode for controlling the switch.

7. The display apparatus according to claim 6, the switch being provided for each of the pixels.

8. The display apparatus according to claim 7, each of the pixels including a driving transistor for outputting a driving current corresponding to an input video signal, and the switch being connected in series between a drain of the driving transistor and the display element.

9. The display apparatus according to claim 6, the switch being commonly provided for the pixels.

10. The display apparatus according to claim 9, the switch being connected between the pixels and the power supply terminals.

11. The display apparatus according to claim 10, one of the pair of electrodes being commonly provided for the pixels.

12. The display apparatus according to claim 4, the dimming circuit varying a duty ratio of the control pulse signal, thereby shortening a period in which the display elements are electrically connected, if the sum of the currents is large, and lengthening the period in which the display elements are electrically connected, if the sum of the currents is small.

13. A control method for a display apparatus, the display apparatus including a display screen which is provided with a plurality of pixels, each of the pixels including a display element and a driving circuit, the display element being provided between a pair of electrodes opposing each other and including an optical layer having an optical characteristic thereof varied in accordance with a current flowing between the electrodes, the driving circuit supplying the display element with a current corresponding to a video signal, comprising:

a step of detecting a display state of the display screen twice or more within a one-frame period; and a step of varying a current supply time to supply a current from the driving circuit to the display element, in accordance with an output from the display state detection circuit, and performing dimming control twice or more within a one-frame period.

* * * * *